US005339641A

United States Patent [19]

Mathis et al.

[11] Patent Number: 5,339,641

[45] Date of Patent: Aug. 23, 1994

[54] CRYOGENIC LIQUID NITROGEN PRODUCTION SYSTEM

[75] Inventors: Mary J. Mathis, Buffalo; James J. Maloney, Tonawanda, both of N.Y.

[73] Assignee: Praxair Technology, Inc., Danbury, Conn.

[21] Appl. No.: 88,499

[22] Filed: Jul. 7, 1993

[51] Int. Cl.[5] ..... F25J 3/02

[52] U.S. Cl. ..... 62/24; 62/28

[58] Field of Search ..... 62/24, 28

[56] References Cited

U.S. PATENT DOCUMENTS

| | | | |
|---|---|---|---|
| 4,415,345 | 11/1983 | Swallow | 62/28 |
| 4,501,600 | 2/1985 | Pahade | 62/28 |
| 4,592,767 | 6/1986 | Pahade et al. | 62/31 |
| 4,664,686 | 5/1987 | Pahade et al. | 62/24 |
| 4,710,212 | 12/1987 | Hanson et al. | 62/23 |
| 4,732,598 | 3/1988 | Rowles et al. | 62/28 |
| 4,734,115 | 3/1988 | Howard et al. | 62/28 |
| 4,778,498 | 10/1988 | Hanson et al. | 62/28 |
| 4,878,932 | 11/1989 | Pahade et al. | 62/24 |
| 4,948,404 | 8/1990 | Delong | 62/23 |
| 5,026,408 | 6/1991 | Saunders et al. | 62/24 |
| 5,041,149 | 8/1991 | Handley | 62/27 |

*Primary Examiner*—Ronald C. Capossela

*Attorney, Agent, or Firm*—Stanley Ktorides

[57] ABSTRACT

A system for producing liquid nitrogen from a nitrogen-containing hydrocarbon stream wherein excess refrigeration existing in a nitrogen rejection unit or in an integrated nitrogen rejection unit-helium rejection unit system is utilized to effectively generate a liquid nitrogen product stream.

10 Claims, 2 Drawing Sheets

CRYOGENIC LIQUID NITROGEN PRODUCTION SYSTEM

TECHNICAL FIELD

This invention relates generally to hydrocarbon processing employing nitrogen rejection and to nitrogen rejection systems integrated with a helium processing system.

BACKGROUND ART

One problem often encountered in the production of natural gas from underground reservoirs is nitrogen contamination. The nitrogen may be naturally occurring and/or may have been injected into the reservoir as part of an enhanced oil recovery (EOR) or enhanced gas recovery (EGR) operation. Natural gases which contain a significant amount of nitrogen may not be saleable, since they do not meet minimum heating value specifications and/or exceed maximum inert content requirements. As a result, the feed gas will generally undergo processing, wherein heavier components such as natural gas liquids are initially removed, and then the remaining stream containing primarily nitrogen and methane is separated cryogenically. A common process for separation of nitrogen from natural gas employs a single column or a double column distillation cycle wherein the feed is separated into a nitrogen-enriched vapor and methane-enriched liquid.

Liquid nitrogen is a desirable product in that it may be employed to provide refrigeration for a process such as a freezing process, or may be stored for subsequent vaporization and use for inerting, nitrogenation or other purposes. The nitrogen generated as a result of a hydrocarbon nitrogen rejection operation is a convenient source of nitrogen. However, production and recovery of nitrogen as liquid is costly because considerable additional equipment is required to use excess refrigeration in the process to condense nitrogen without upsetting the stability and separation efficiency of the process.

Accordingly it is an object of this invention to provide a system for the production of liquid nitrogen which is effectively employed in conjunction with a hydrocarbon processing system using a nitrogen rejection unit.

SUMMARY OF THE INVENTION

The above and other objects of which will become apparent to one skilled in the art upon a reading of this disclosure are attained by the present invention, one aspect of which is:

A method for producing liquid nitrogen comprising:

(A) passing a feed comprising nitrogen and methane into a column and separating the feed in the column into a nitrogen-enriched vapor and a methane-enriched liquid;

(B) withdrawing nitrogen-enriched vapor from the column and increasing the pressure of nitrogen-enriched vapor to produce pressurized nitrogen-enriched vapor;

(C) condensing the pressurized nitrogen-enriched vapor by indirect heat exchange with methane-enriched liquid to produce liquid nitrogen;

(D) subcooling the liquid nitrogen by indirect heat exchange with cold vapor; and (E) recovering the resulting liquid nitrogen as product.

Another aspect of the invention is:

Apparatus for producing liquid nitrogen comprising:

(A) a column and means for providing feed into the column;

(B) a compressor and means for passing vapor from the column to the compressor;

(C) a reboiler and means for passing vapor from the compressor to the reboiler;

(D) a subcooler and means for passing liquid from the reboiler to the subcooler; and (E) means for recovering liquid from the subcooler.

The term "column" is used herein to mean a distillation, rectification or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column, or on packing elements, or a combination thereof. For an expanded discussion of fractionation columns see the Chemical Engineers's Handbook, Fifth Edition, edited by R. H. Perry and C. H. Chilton, McGraw Hill Book Company, New York Section 13, "Distillation" B. D. Smith et al., page 13-3, *The Continuous Distillation Process.*

The term "double column", is used herein to mean a high pressure column having its upper end in heat exchange relation with the lower end of a low pressure column. An expanded discussion of double columns appears in Ruheman, "The Separation of Gases" Oxford University Press, 1949, Chapter VII, Commercial Air Separation.

The terms "nitrogen rejection unit" and "NRU" are used herein to mean a facility wherein nitrogen and methane are separated by cryogenic rectification, comprising a column and the attendant interconnecting equipment such as liquid pumps, phase separators, piping, valves and heat exchangers.

The term "indirect heat exchange" is used herein to mean the bringing of two fluid streams into heat exchange relation without any physical contact or intermixing of the fluids with each other.

As used herein the term "phase separator" means a device, in which a two phase fluid separates into vapor and liquid at the vapor side and liquid side respectively.

As used herein, the term "compressor" means a device for increasing the pressure of a gas.

As used herein, the term "subcooler" means a device in which a liquid is cooled to a temperature lower than that liquid's saturation temperature for the existing pressure.

As used herein, the term "liquid nitrogen⇄ means a liquid having a nitrogen concentration of at least 95 mole percent.

As used herein, the term "reboiler" means a heat exchange device which generates column upflow vapor from column liquid. A reboiler may be physically within or outside a column.

DETAILED DESCRIPTION

The invention will be described in detail with reference to the Drawings.

Figure 1:
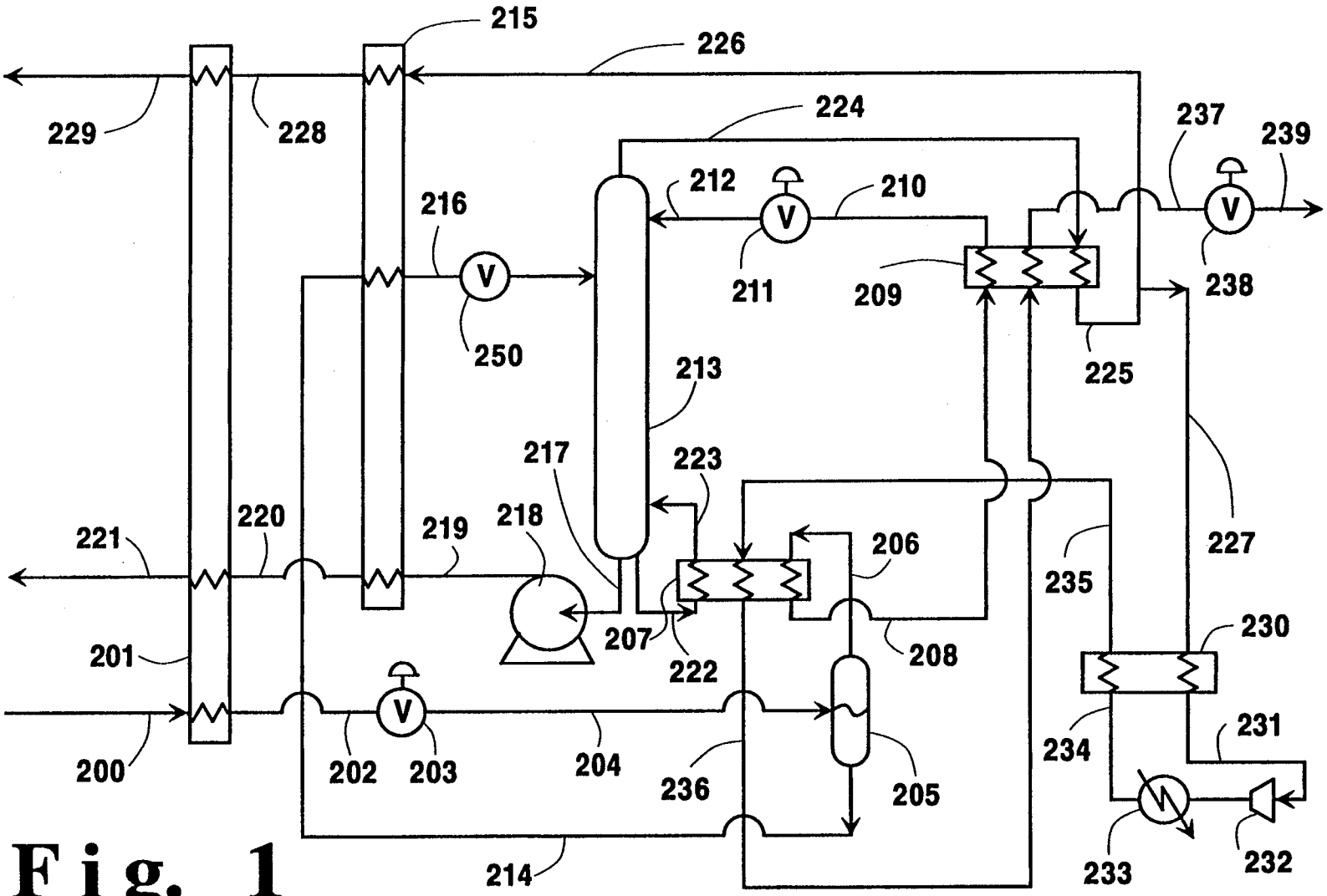
FIG. 1 is a schematic flow diagram of one preferred embodiment of the liquid nitrogen production system of this invention wherein the cold vapor is low pressure nitrogen vapor from a nitrogen rejection unit.

Referring now to FIG. 1, stream 200 comprising methane and nitrogen is cooled and generally partially condensed by passage through heat exchanger 201. Stream 200 may contain from 5 to 80 mole percent nitrogen and may be at any pressure, such as from 85 to 2000 pounds per square inch absolute (psia) or more. Stream 200 may contain other components in relatively small amounts. The other components include carbon dioxide and higher hydrocarbons such as ethane, propane, i-butane, and n-butane.

Cooled stream 202 is reduced in pressure by passage through valve 203. The pressure reduction through valve 203 generally causes some of stream 202 to vaporize and lowers the temperature of the feed stream. Resulting two-phase stream 204 is passed into phase separator 205 wherein it is divided into a vapor portion and a liquid portion.

The vapor portion, which has a greater concentration of nitrogen than does stream 200, is passed as stream 206 through heat exchanger 207 wherein it is condensed. The condensed stream 208 is subcooled by passage through subcooler 209. Subcooled stream 210 is reduced in pressure by passage through valve 211 and the resulting stream 212 is introduced into column 213 which is operating as a pressure within the range of from 15 to 200 psia. Column 213 may be the column of a single column NRU, one of the columns of a double column NRU, or it may be the upper column of a modified double column NRU as in the embodiment illustrated in FIG. 1.

Within column 213 stream 212 and the other feed stream into column 213 which will be described later are separated by cryogenic rectification into nitrogen-enriched vapor and methane-enriched liquid. Stream 212 serves to provide liquid reflux for this cryogenic rectification. The liquid portion from phase separator 205, which has a greater concentration of methane than does stream 200, is passed as stream 214 from phase separator 205 and is subcooled by passage through heat exchanger 215. Resulting subcooled stream 216 is passed through valve 250 and introduced into column 213 as feed for the aforesaid cryogenic separation into nitrogen-enriched vapor end methane-enriched liquid.

Methane-enriched liquid is removed from column 213 as stream 217, is pumped to a higher pressure through pump 218, and the resulting stream 219 is warmed by passage through heat exchanger 215 to form stream 220, further warmed by passage through heat exchanger 201 to form stream 221 and recovered as product methane. Generally stream 221 has a methane concentration of at least 80 mole percent and typically the methane concentration of stream 221 will be about 95 mole percent or greater.

Reboiler duty for column 213 is provided by withdrawal of methane-enriched liquid stream 222 and vaporization of this stream by indirect heat exchange with condensing pressurized nitrogen-enriched vapor in heat exchanger 207, as will be more fully described later, as well as vapor stream 206 from phase separator 205. Resulting stream 223 is returned to column 213 for vapor upflow for the column.

Nitrogen-enriched vapor is removed from column 213 as stream 224. This stream serves to provide the cold vapor for the subcooling of the liquid nitrogen. Stream 224 is warmed by indirect heat exchange through subcooler 209. The resulting stream 225 is divided into streams 226 and 227. Stream 226 is warmed by passage through heat exchanger 215 to form stream 228 and further warmed by passage through heat exchanger 201 to form stream 229 which may be recovered, resected into an oil or gas reservoir for enhanced hydrocarbon recovery, or simply released to the atmosphere.

Nitrogen-enriched vapor stream 227 is warmed by passage through heat exchanger 230. Resulting warmed stream 231 is increased in pressure, generally to a pressure within the range of from 130 to 350 psia, by passage through compressor 232 and cooled to remove heat of compression through cooler 233. Resulting pressurized nitrogen-enriched vapor 234 is cooled by passage through heat exchanger 230 to produce pressurized nitrogen-enriched vapor stream 235.

Stream 235 is condensed to produce liquid nitrogen by passage through reboiler 207 by indirect heat exchange with methane-enriched liquid taken as stream 222 from column 213 as was previously described. Liquid nitrogen is withdrawn from reboiler 207 as stream 236 and passed to subcooler 209 wherein it is subcooled by indirect heat exchange with cold vapor 224 which generally has a nitrogen concentration greater than 95 mole percent. The resulting subcooled liquid nitrogen is passed as stream 237 from subcooler 209 through valve 238 and recovered as product liquid nitrogen in stream 239. The production of liquid nitrogen takes advantages of the excess refrigeration available in the process due to the pressure let down of process streams which produces Joule-Thompson refrigeration. The subcooling of the liquid nitrogen against cold vapor reduces the amount of nitrogen lost as flash-off vapor.

Figure 2:
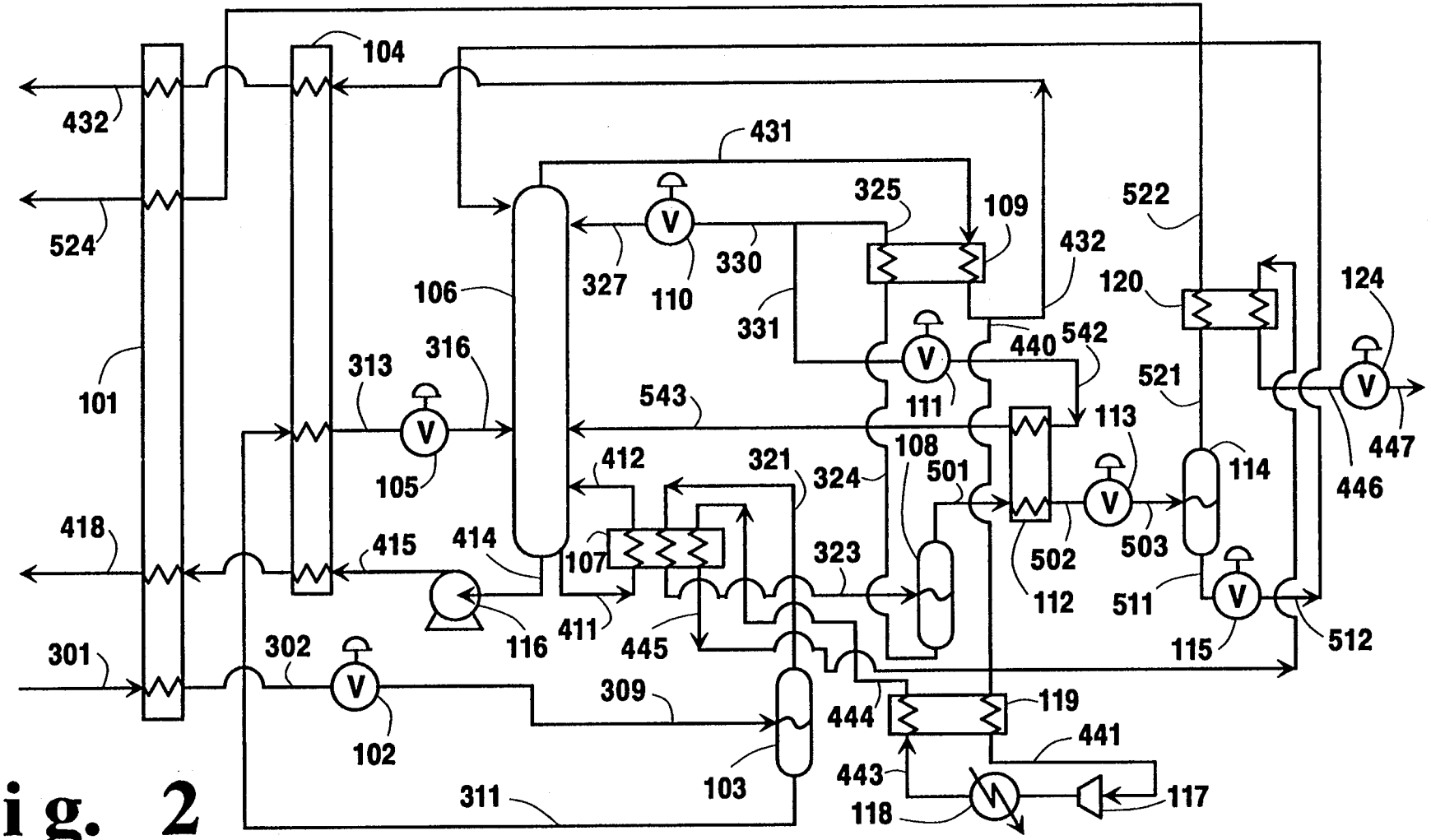
FIG. 2 is a schematic flow diagram of another preferred embodiment of the liquid nitrogen production system of this invention wherein the cold vapor is helium-containing vapor from a helium rejection unit integrated with a nitrogen rejection unit.

FIG. 2 illustrates another embodiment of the invention wherein the cold vapor is helium-containing vapor. Referring now to FIG. 2, feed introduced into the column comprising nitrogen and methane is passed into column 106. Typically the nitrogen concentration within the feed will be within the range of from 5 to 80 mole percent and the methane concentration within the feed will be within the range of from 20 to 95 mole percent. Column 106 may be the column of a single column NRU, one of the columns of a double column NRU, or it may be the upper column of a modified double column NRU as in the embodiment illustrated in FIG. 2. Column 106 generally is operating at a pressure within the range of from 150 to 200 psia.

Within column 106 the feed is separated by cryogenic rectification into a nitrogen-enriched vapor, having a nitrogen concentration which exceeds that of the feed, and into a methane-enriched liquid having a methane concentration which exceeds that of the feed.

The embodiment illustrated in FIG. 2 is another preferred embodiment wherein the NRU system which produces the liquid nitrogen product is integrated with a helium rejection unit (HRU) which produces the helium for the downstream requisite subcooling. In this embodiment stream 301, which, for example, may be taken from an upstream stripping column and which contains helium in addition to nitrogen and methane, is cooled and partially condensed by passage through heat exchanger 101. Resulting stream 302 is passed through valve 102 and emerges as stream 309 which is passed into phase separator 103. Liquid comprising nitrogen and methane is passed out of separator 103 as stream 311 and cooled by passage through heat exchanger 104.

Resulting stream 313 is passed through valve 105 and emerges as stream 316 which is the feed into NRU column 106.

Nitrogen-enriched vapor is withdrawn from column 106 as stream 431 which generally has a nitrogen concentration greater than 95 mole percent, is warmed by passage through heat exchangers 109, 104 and 101 and passed out of the system as stream 432. Some of the nitrogen-enriched vapor withdrawn from column 106 and exiting heat exchanger 109, shown in FIG. 2 as stream 440, is warmed by passage through heat exchanger 119. Resulting warmed stream 441 is increased in pressure, generally to a pressure within the range of from 130 to 490 psia, by passage through compressor 117 and cooled to remove heat of compression through cooler 118. Resulting pressurized nitrogen-enriched vapor 443 is cooled by passage through heat exchanger 119 to produce pressurized nitrogen-enriched vapor stream 444.

Stream 444 is condensed to produce liquid nitrogen by passage through reboiler 107 by indirect heat exchange with methane-enriched liquid taken as stream 411 from column 106. The methane-enriched liquid vaporizes by the heat exchange in reboiler 107 and resulting methane-enriched vapor is passed back into column 106 as stream 412 to serve as vapor upflow for the cryogenic rectification. Methane liquid, generally having a methane concentration within the range of from 90 to 100 mole percent is withdrawn from column 106 as stream 414. This methane liquid is preferably pumped to a higher pressure by passage through liquid pump 116 as illustrated in FIG. 2. Resulting stream 415 is passed through and heat exchangers 104 and 101 wherein it is warmed and preferably vaporized. Resulting stream 418 may be recovered as product methane.

Liquid nitrogen is taken from reboiler 107 as stream 445 and subcooled by indirect heat exchange with cold vapor in subcooler 120. The cold vapor has a helium concentration within the range of from 25 to 100 mole percent, preferably within the range of from 50 to 100 mole percent. The resulting subcooled liquid nitrogen is passed as stream 446 from subcooler 120 through valve 124 and recovered as liquid nitrogen product in stream 447. The production of liquid nitrogen takes advantage of the excess refrigeration available in the process due to the pressure let down of process streams which produces Joule-Thompson refrigeration. The subcooling of the liquid nitrogen against cold helium-containing vapor reduces the amount of nitrogen lost as flash-off vapor.

As mentioned, the embodiment illustrated in the FIG. 2 is a particularly preferred embodiment wherein the NRU is integrated with an HRU and the helium-containing cold vapor employed to subcool the liquid nitrogen is produced by the HRU. As previously described, stream 309 is separated in phase separator 103 into a first fluid enriched in nitrogen and methane which is ultimately passed as feed into column 106, and into a second fluid enriched in helium. This second fluid is ultimately employed as the aforesaid helium-containing cold vapor. In the embodiment illustrated in FIG. 2 this second fluid undergoes a series of partial condensations prior to being used as the helium-containing cold vapor in subcooler 120.

Referring back now to FIG. 2, helium-containing vapor or second fluid 321 is passed from the vapor side of phase separator 103 through reboiler 107 wherein it is partially condensed. Resulting two phase stream 323 is passed into phase separator 108 and liquid is passed in stream 324 from phase separator 108 through heat exchanger 109. Resulting stream 325 is divided into two portions. A first stream 330 is flashed through valve 110 and passed as two phase stream 327 into column 106. Second stream 331 is throttled across valve 111 and resulting stream 542 is vaporized by passage through heat exchanger 112. Resulting stream 543 is passed into column 106 as additional feed.

Helium-containing vapor is withdrawn from the vapor-side of phase separator 108 as stream 501 and partially condensed by passage through heat exchanger 112. The resulting fluid is passed out of heat exchanger 112 as stream 502, through valve 113, and as stream 503 into phase separator 114. Liquid is withdrawn from the liquid side of separator 114 as stream 511 passed through valve 115 and passed as stream 512 into the upper portion of column 106 as reflux. Helium-containing vapor is withdrawn from the vapor side of separator 114 as stream 521 and employed as the aforesaid helium-containing cold vapor in subcooler 120. Resulting stream 522 is warmed by passage through heat exchanger 101 and removed from the system as stream 524. Stream 524 may be recovered as crude helium for further processing in a helium refinery.

In the practice of this invention the cold vapor employed for the subcooling of the liquid nitrogen will have a temperature generally within the range of from 60 to 125 degrees Kelvin. When the cold vapor is helium-containing cold vapor, its temperature will generally be in the lower portion of this range.

Although the invention has been described in detail with reference to a certain preferred embodiments those skilled in the art will recognize that there are other embodiments of the invention within the spirit and scope of the claims. For example, the subcooling of the liquid nitrogen by the helium-containing cold vapor need not take place in a separate subcooler but rather these fluids could be passed in countercurrent indirect heat exchange relation through, for example, heat exchanger 109 which would then be the subcooler of the invention. In addition, the methane-enriched liquid employed to liquefy the nitrogen-enriched vapor need not be taken from the bottom of the column but may be taken from any suitable point in the column.

We claim:

1. A method for producing liquid nitrogen comprising:

(A) passing a feed comprising nitrogen and methane into a column and separating the feed in the column into a nitrogen-enriched vapor and a methane-enriched liquid;

(B) withdrawing nitrogen-enriched vapor from the column and increasing the pressure of nitrogen-enriched vapor to produce pressurized nitrogen-enriched vapor;

(C) condensing the pressurized nitrogen-enriched vapor by indirect heat exchange with methane-enriched liquid to produce liquid nitrogen;

(D) subcooling the liquid nitrogen by indirect heat exchange with cold vapor; and (E) recovering the resulting liquid nitrogen as product.

2. The method of claim 1 wherein the cold vapor has a nitrogen concentration greater than 95 mole percent.

3. The method of claim 1 wherein the cold vapor is a helium-containing vapor having a helium concentration within the range of from 25 to 100 mole percent.

4. The method of claim 3 further comprising providing a stream containing nitrogen, methane and helium, separating this stream into a first fluid enriched in nitrogen and methane and into a second fluid enriched in helium, employing the first fluid as said feed passed into the column, and employing the second fluid as said helium-containing vapor.

5. The method of claim 4 further comprising partially condensing the second fluid, employing resulting vapor as said helium-containing vapor, and passing resulting liquid into the column.

6. The method of claim 5 wherein the second fluid is partially condensed by indirect heat exchange with methane-enriched liquid.

7. Apparatus for producing liquid nitrogen comprising (A) a column and means for providing feed into the column;

(B) a compressor and means for passing vapor from the column to the compressor;

(C) a reboiler, means for passing liquid from the column to the reboiler and means for passing vapor from the compressor to the reboiler;

(D) a subcooler, means for providing cold vapor to the subcooler and means for passing liquid from the reboiler to the subcooler; and (E) means for recovering liquid from the subcooler.

8. The apparatus of claim 7 further comprising a phase separator, means for passing fluid from the lower portion of the phase separator as feed into the column and means for passing fluid from the upper portion of the phase separation to the subcooler.

9. The apparatus of claim 8 wherein the means for passing fluid from the upper portion of the phase separator to the subcooler includes at least one other phase separator and at least one heat exchanger.

10. The apparatus of claim 9 wherein said at least one heat exchanger includes the said reboiler.

* * * * *

UNITED STATES PATENT AND TRADEMARK OFFICE

CERTIFICATE OF CORRECTION

PATENT NO. : 5,339,641

DATED : August 23, 1994

INVENTOR(S) : M.J. Mathis etal

It is certified that error appears in the above-identified patent and that said Letters Patent is hereby corrected as shown below:

In column 4, line 7 delete "resected" and insert therefor --reinjected--.

Signed and Sealed this

Eleventh Day of October, 1994

Bruce Lehman

*Attest:*

BRUCE LEHMAN

*Attesting Officer*

*Commissioner of Patents and Trademarks*